United States Patent [19]

Brandstetter et al.

[11] Patent Number: 4,988,001

[45] Date of Patent: Jan. 29, 1991

[54] MULTI-UNIT PACKAGE FOR MAGNETIC TAPES WOUND ON TO CORES

[75] Inventors: Hermann Brandstetter; José Toral; August Liepold, all of Munich, Fed. Rep. of Germany

[73] Assignee: Agfa-Gevaert Aktiengessellschaft, Leverkusen, Fed. Rep. of Germany

[21] Appl. No.: 462,789

[22] Filed: Jan. 10, 1990

[30] Foreign Application Priority Data

Jan. 24, 1989 [DE] Fed. Rep. of Germany ... 8900709[U]

[51] Int. Cl.[5] ..... B65D 85/67

[52] U.S. Cl. ..... 206/394; 206/303; 206/415; 206/416; 206/413; 206/497; 206/523

[58] Field of Search ..... 206/303, 394, 408, 410, 206/413–416, 444, 523, 583, 585, 591, 593, 821, 497

[56] References Cited

U.S. PATENT DOCUMENTS

| | | | |
|---|---|---|---|
| 3,524,540 | 8/1970 | Brown et al. | 206/444 |
| 3,543,922 | 12/1970 | Charlton | 206/444 |
| 3,753,490 | 8/1973 | Mowrey | 206/444 |
| 3,785,184 | 1/1974 | Wirth | 206/303 |
| 3,792,507 | 2/1974 | Szabrak et al. | 206/444 |
| 4,081,151 | 3/1978 | Ender et al. | 206/394 |
| 4,195,733 | 4/1980 | Abel | 206/444 |
| 4,457,429 | 7/1984 | Huber et al. | 206/408 |
| 4,516,678 | 5/1985 | Fotiadis et al. | 206/523 |
| 4,708,246 | 11/1987 | Minion | 206/394 |
| 4,792,044 | 12/1988 | Nishizawa et al. | 206/394 |

*Primary Examiner*—David T. Fidei

*Attorney, Agent, or Firm*—Connolly & Hutz

[57] ABSTRACT

Package for pancakes, consisting of plate-like plastic pallets (1) which protect the outer pancakes and, if necessary, raised rubs (3) in the center of the pallets, the diameter of which corresponds to the inside diameter of the bores of the winding cores and wherein the package can be sealed by means of a shrink film (4) coated thereon. The inner surfaces (2) of the plastic pallets (1) taper off in a sloping manner towards the outside at least in the region of the tape reel (5) of the pancakes, so that the inner surfaces (2) rest against the pancake in a uniform manner over the entire region of the tape reel (5) (FIG. 1).

4 Claims, 1 Drawing Sheet

MULTI-UNIT PACKAGE FOR MAGNETIC TAPES WOUND ON TO CORES

BACKGROUND OF THE INVENTION

1. Field of the Invention

The invention relates to a package for a number of recording materials in tape form (known as pancakes) wound on to flangeless winding cores provided with inner bores, consisting of plate-like plastic pallets which protect the outer pancakes and, if necessary, raised hubs in the centre, the diameter of which corresponds to the inside diameter of the bores of the winding cores, wherein the package can be sealed by means of a shrink film coated thereon.

2. Description of the Related Art

Packages known as plain packages are sold by magnetic tape manufacturers worldwide. In these, the magnetic tape is wound on to cores, e.g. flangeless winding cores (either those known as NAB cores, or stackable winding cores according to U.S. Pat. No. 081,151 or the like). At present, these pancakes are either packaged individually or are shrunk in multi-unit packages and containers or are held in various forms of cardboard packaging. A package of this kind is known from GB No. 1 576 973.

The disadvantage of the multi-unit package described hereinabove consists in that, although the outer layers are protected by means of styropor plates and, moreover, the stacked pancakes are sealed by a shrink film, the magnetic tapes are not afforded maximum protection. The following defects can occur during storage or transport:

As a result of the shrunk package, the outer edges are stressed and exert pressure on the magnetic tapes contained therein, so that the magnetic tape reel may be subject to plate-like deformation.

In the case of horizontal transportation, i.e. when the tape reel or winding core is disposed horizontally, step formation and/or slipping can occur, thus damaging the magnetic tape.

Multi-unit packages of the type specified in the precharacterising part of claim 1 are known from EP 0 320 751, in which reusable, lockable or screwable core supports help to avoid the abovementioned disadvantages. However, a large number of components are then required, resulting in disadvantages in terms of cost for this method of packaging.

A multi-unit package for pancakes is known from U.S. Pat. No. 4,708,246, in which the intermediate layers between the pancakes are adapted to the shape thereof. However, this means that a large quantity of packaging material is required. The multi-unit package for stacked frangible articles according to U.S. Pat. No. 2,776,772 has similar disadvantages.

SUMMARY OF THE INVENTION

Therefore, the object of the invention is to find a multi-unit package which does not have the abovementioned disadvantages, but instead affords the best possible protection to the pancakes and which, in addition, is easy to handle and can be manufactured and used at favourable costs.

The problem is solved according to the invention by a package as described below.

BRIEF DESCRIPTION OF THE DRAWINGS

Further details of the invention are given in the subclaims, the description and the drawings.

The invention will now be described in more detail with reference to the accompanying drawings, in which.

DESCRIPTION OF THE PREFERRED EMBODIMENT

Figure 1:
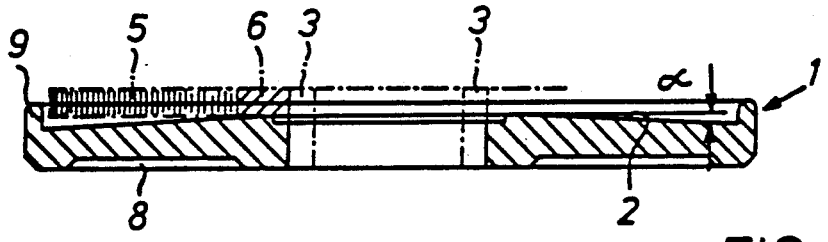
FIG. 1 shows a section through a plastic pallet according to the invention.

A packing device for a package for a number of recording materials in tape form (known as pancakes) wound on to flangeless winding cores (6) provided with inner bores, consists of plate-like plastic pallets (1), which protect the outer pancake and have central bores (10) and, if necessary, raised hubs (3) in the centre of the pallets, the diameter of which corresponds to the inside diameter of the bores of the winding cores, and wherein the package can be sealed by means of a shrink film (4) coated thereon, characterised in that the inner surfaces (2) of the plastic pallets (1) taper off in a sloping manner towards the outside at least in the region of the tape reel (5) of the pancakes.

As shown in FIG. 1, the plastic pallet (1) has the central bore 10 and on its inner surface (2) an essentially flat plate-like stop having a rim (9) and, if necessary, the raised circular hub (3) in the centre, the diameter of which corresponds to the inside diameter of the bores, and the height of which corresponds approximately to the total height of the winding core (6). The winding cores, e.g. NAB or NARTB cores, have standardised dimensions, as known by any expert in the magnetic tape field.

In the region of the winding core, the inner surface of the pallet can have one or more steps. The remainder of the design of the inner surface is preferably as described in GB 1 576 973 mentioned hereinbefore. The recesses formed by the abovementioned steps serve to receive axial deformations of the winding cores according to U.S. Pat. No. 4,081,151.

Figure 3:
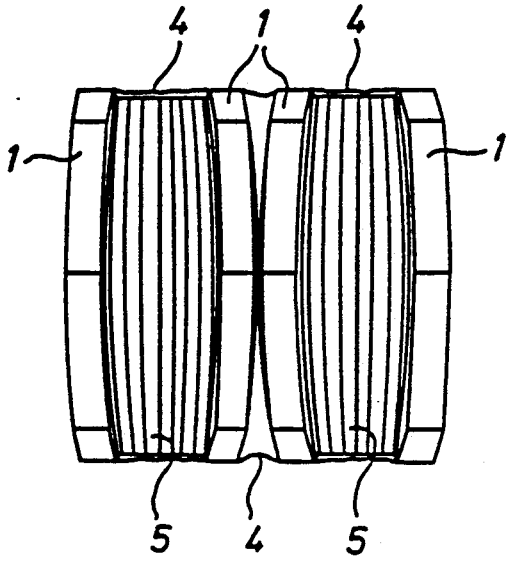
FIG. 3 shows a side view of two complete shrunk multi-unit packages according to the invention, together with their contents, in the vertical transportation position.

According to the invention, in the region of the tape reel (5) the inner surface (2) of the magnetic tape wound on to the core (6) tapers off in a sloping manner towards the outside. The cone angle $\alpha$ is measured so that when the multi-unit package consisting of a number of pancakes stacked on top of one another is in its finished packed state, sealed by shrink film, the two winding surfaces facing towards the inner surfaces of the pallet (2) rest against the winding region (5) with uniform light pressure over the entire area thereof. As the shrink film exerts pressure on the periphery of the multi-unit package, said package is deformed, as illustrated in FIG. 3. The cone angle can be between 1° and 10° depending on the shrinking pressure of the film and on the thickness of the pallet plates.

Figure 2:
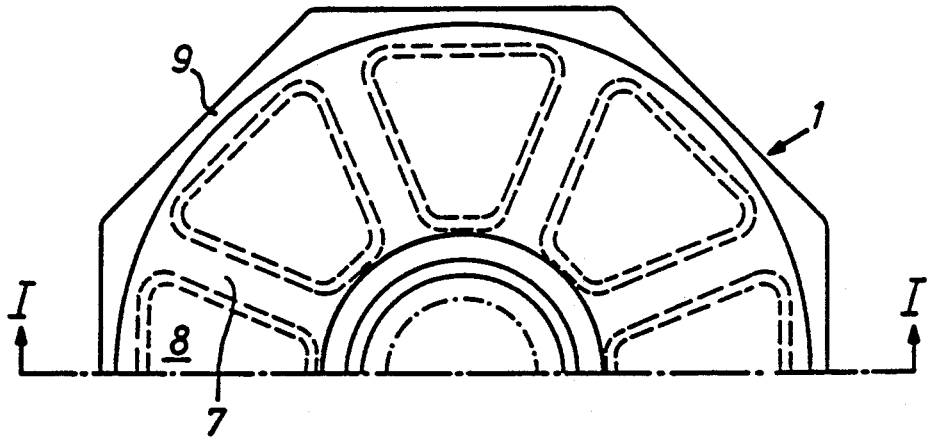
FIG. 2 shows a top view of a partial section of the inner surface of the plastic pallet according to the invention.

The outer surface of the pallet, made, e.g. from foamed polystyrene, is shown by way of example in FIG. 2. Accordingly, spoke-like ribs (7) also extending over the external and internal circumferences of the plate can be provided, recesses (8) being disposed therebetween. The external circumference of the pallet plate can be circular, but is preferably polygonal, e.g. octagonal.

EXAMPLE

A magnetic tape having a width of 3.81 mm was wound on to flangeless stackable interlocking winding cores according to U.S. Pat. No. 4,081,151, with a winding surface with a width of 3.90 mm. The diameter of the pancakes in the wound state was 295 mm. Sets of 15 pancakes were placed on a styropor pallet having a thickness of approximately 20 mm, the inner surface of which tapered off with a cone angle of $\alpha=3°$ in the winding region. In the stacked state, therefore, the winding surfaces of the tape reel (5) were disposed slightly at a distance from one another. A cardboard disc having a thickness of approximately 1 mm was placed on top, then another 15 pancakes were stacked on top, and subsequently were covered by another plastic pallet (1) according to the invention. A cardboard sleeve was inserted into the bore of the stacked winding cores. The package was then sealed by means of a polyethylene terephthalate film having a thickness of approximately 50 $\mu$m and was shrunk in an oven as known in the prior art.

In a comparative example, a similar multi-unit package was built up from $2\times15$ pancakes and was shrunk under identical conditions. The only difference was that the inner surfaces of the pallets did not taper off in a sloping manner, but instead were plane-parallel with the outer surfaces. Once the shrunk package placed on one of the polygonal surfaces of the pallet had undergone two weeks' storage and repeated transport under normal climatic conditions, the said package was opened and the winding state of the two outermost pancakes was measured. The pancakes which until that point had been stored in the package according to the invention displayed axial displacement ("plate value") of just under 0.3 mm in the outer region, as against the inner region, while the pancakes in the conventional package had a plate value of 1.5 mm. In the case of conditioned storage (heat, cold), the differences were in part considerably greater once again.

The advantages obtained by the invention can be summarised as follows:

the pressure exerted on the outer pancakes after shrinking of the package is reduced, thus reducing the risk of plate formation light pressure, evenly distributed over the entire winding region, is exerted on the outer pancakes after the shrinking process, thus reducing the risk of the formation of a stepped package there is increased pressure in the core region and a corresponding reduction in pressure in the peripheral region of the package the outer surfaces of the styropor plates have a slightly convex shape as a result of the shrinking process. In this way any physical shock and jolts to which the vertically stacked packages and containers may be subjected during storage and transport only affect the core region.

We claim:

1. A packing device for containing a plurality of pancakes consisting of tape windings of magnetic tape wound on flangeless winding cores having inner bores comprising:

a pallet for engaging pancakes in a package and having a central bore and a sloping inner surface, said surface being engageable with magnetic tape windings and being tapered in the region of engagement with a preselected slope at a cone angle relative to a reference plane diametric of the central bore, said pallet being engageable by a shrink film wrapping, said cone angle being provided so that when said shrink film wrapping engages said pallet, the inner surface rests against the magnet tape winding with substantially uniform pressure over an area of the tape.

2. Packing device according to claim 1, characterised in that the cone angle $\alpha$ is of the order of 1° to 10 °.

3. Packing device according to claim 1, characterised in that the winding cores are stackable cores in which an axial, cylindrical bore and a peripheral winding surface situated centrally with respect to the medial plane of the core, the annular body having horizontal surfaces between the cylindrical bore and the winding surface, the annular body being provided with deformations which project from a medial plane of the core alternately upwardly and downwardly by about the width of the annular body and protrude beyond the horizontal surface of the annular body by about half the width of the annular body and the deformations on both sides of the winding core being interlockable with each other when the cores are stacked so that the peripheral winding surfaces of adjacent cores are situated closely adjacent one another, protected against rotation as a result of axial deformations on both sides.

4. Packing device according to claim 1, characterised in that the pallets are made of foamed polystyrene and are provided on their exterior with spoke-like reinforcing elements (7) between which recesses (8) are formed.

* * * * *